United States Patent [19]

Richter et al.

[11] Patent Number: 4,976,586

[45] Date of Patent: Dec. 11, 1990

[54] PUMP WITH SEPARATE FLUIDIZING VANED SHAFT ADJACENT IMPELLER

[75] Inventors: Johan C. F. C. Richter, Oslo, Norway; Ole J. Richter, Karlstad, Sweden

[73] Assignee: Kamyr AB, Karlstad, Sweden

[21] Appl. No.: 381,067

[22] Filed: Jul. 18, 1989

[51] Int. Cl.[5] ..... F04D 1/10

[52] U.S. Cl. ..... 415/143; 415/62; 415/68; 55/199; 55/203; 55/409; 162/52; 366/294

[58] Field of Search ..... 415/143, 168.1, 60, 415/62, 66, 68; 55/199, 203, 409; 162/52; 366/293, 294, 295, 296

[56] References Cited

U.S. PATENT DOCUMENTS

| | | | |
|---|---|---|---|
| 3,164,330 | 1/1965 | Neidl | 415/143 |
| 4,093,506 | 6/1978 | Richter | 162/17 |
| 4,435,193 | 3/1984 | Gullichsen et al. | 55/21 |
| 4,531,892 | 7/1985 | Nasman et al. | 417/205 |
| 4,637,779 | 1/1987 | Sherman et al. | 415/143 |
| 4,770,604 | 9/1988 | Luthi et al. | 415/143 |
| 4,826,398 | 5/1989 | Gullichsen | 415/143 |
| 4,884,943 | 12/1989 | Niskanen | 415/143 |

FOREIGN PATENT DOCUMENTS

| | | | |
|---|---|---|---|
| 517377 | 2/1931 | Fed. Rep. of Germany | 415/143 |
| 926372 | 5/1982 | U.S.S.R. . | |

OTHER PUBLICATIONS

A. S. Myrens Verksted Brochure.

"Handbook for Pulp & Paper Technologists", Smook et al.; TAPPI; Canadian Pulp & Paper Assn., pp. 111–113.

*Primary Examiner*—John T. Kwon

*Attorney, Agent, or Firm*—Nixon & Vanderhye

[57] ABSTRACT

A pumping system is capable of handling a paper pulp suspension of medium consistency (e.g. about 8–15% solids consistency) utilizing a conventional centrifugal pump. A conventional pump system capable of handling 3–8% consistency pulp may be retrofit to handle 8–15% consistency pulp. A tube with vanes, and having an open end, extends through the inlet to the pump so that there is a small clearance between the vanes and the inlet, and so that the open end is adjacent but spaced from the hub of the pump impeller. A gas passage extends from the hollow interior of the tube to an area remote from the pump. The tube is rotated in a direction of rotation opposite to the direction of rotation of the pump impeller, and at a speed sufficient to fluidize pulp of about 8–15% consistency, and to force the pulp toward the pump. Gas which collects at the pump impeller is withdrawn through the tube and a gas passage in a shaft connected to the tube, and for that purpose a vacuum pump may be utilized.

18 Claims, 2 Drawing Sheets

PUMP WITH SEPARATE FLUIDIZING VANED SHAFT ADJACENT IMPELLER

BACKGROUND AND SUMMARY OF THE INVENTION

Especially in the pulp and paper field, it is highly desirable to be able to pump suspensions having a medium consistency, e.g. about 8–15% solids. In the pulp and paper art, this is typically accomplished utilizing a degassing pump having an impeller of a centrifugal pump rotating at a speed sufficient to effect fluidization. Such a degassing pump is shown by U.S. Pat. No. 4,435,193. While such pumps are successful, there are many installations today where it is difficult or impractical to retrofit such a pump.

According to the present invention, a pumping system and method are provided that allow an ordinary paper pulp stock pump, designed for handling stock of about 3–8% consistency, to pump medium consistency pulp as well. The system according to the invention may be retrofit, although under some circumstances it is even desirable to provide a complete system according to the invention in new installations. The pumping system according to the invention does not in any way affect the mounting, speed of operation, or any other parameters of the ordinary stock pump, but merely provides additional elements that are not connected to, although they operatively interact with, the ordinary centrifugal stock pump, to alloW it to pump medium consistency suspensions.

According to one aspect of the present invention, a pumping system for suspensions is provided which comprises the following elements: (a) A centrifugal pump having a housing containing an impeller, the impeller having a hub and blades. (b) Means for rotating the impeller about an impeller axis, in a first direction of rotation. (c) Means defining an inlet to the housing, and an outlet from the housing, for suspension being pumped. (d) A vaned tubular element having an open end. (e) Means for mounting the tubular element for rotation about an axis generally in line with the impeller axis, and so that the open end extends through the inlet so that it is positioned adjacent, but spaced from, the hub. And, (f) means for rotating the tube about its axis in a second direction of rotation, opposite the first direction.

According to another aspect of the present invention, a pumping system is provided specifically for pumping suspensions having a solids content of about 8–15%. The pumping system comprises: (a) A centrifugal pump having a housing containing an impeller, the impeller having a hub and blades. (b) Means for rotating the impeller about an impeller axis, in a first direction of rotation. (c) Means defining an inlet to the housing, and an outlet from the housing, for suspension being pumped. (d) A vaned tubular element having an open end. (e) Means for mounting the tubular element for rotation about an axis generally in line with the impeller axis, and so that the open end extends through the inlet so that it is positioned adjacent, but spaced from, the hub. (f) Means for rotating the tube about its axis at a velocity sufficient to fluidize the suspension of consistency about 8–15%. (g) The means defining the inlet comprising a throat, the throat, tube, and vanes on the tube dimensioned so that there is a narrow clearance between the vanes and the throat to facilitate fluidization of the suspension by the tube. The means (e) and (f) comprise a shaft with a gas passage operatively communicating with the hollow interior of the tube, and (h) means are provided for withdrawing gas from the tube and gas passage. The means (h) may include a vacuum pump.

Preferably the centrifugal pump consists essentially of the housing and impeller, being devoid of gas withdrawal means. Also, the system is ideally mounted in a generally vertically disposed vessel for containing the suspension, the pump being disposed adjacent the bottom of the vessel and all of the elements of the pump system being mounted so that the impeller axis is generally horizontal.

According to a method of the present invention, it is possible to pump a suspension of cellulosic fibrous material (paper pulp) having a consistency of about 8–15% utilizing the apparatus earlier described. The method comprises the steps of: (a) Feeding the cellulosic fibrous material suspension at a consistency of 8–15% toward the inlet to the pump housing. (b) Rotating the tube at a velocity sufficient to cause the suspension to be fluidized and to be forced toWard the pump impeller. (c) Rotating the pump impeller to effect discharge of the suspension from the pump outlet. And, the further step (d) of withdrawing gas from adjacent the impeller. Step (d) preferably consists essentially of the step of causing gas to flow through the tube to be discharged at a position remote from the impeller, and steps (b) and (c) are practiced to cause the impeller to rotate in the direction opposite the direction of rotation of the tube.

According to yet another aspect of the present invention there is provided a method of retrofitting a centrifugal pumping system capable of handling cellulosic fibrous material suspension having a consistency of about 3–8%, so that it is capable of pumping a suspension having a consistency of up to about 15%. The method comprises the steps of: (a) Mounting a vaned hollow tube so that it extends through the inlet to the centrifugal pump, with an open end of the tube mounted adjacent, but spaced from, the hub of the impeller, and with the tube vanes having a small clearance between them and the inlet to the housing, and mounting the tube so that it is rotatable about an axis generally coincident with the impeller axis. (b) Rotating the tube in a direction of rotation opposite to the direction of rotation of the impeller, and at a speed sufficient to fluidize pulp suspension having a consistency of up to about 15% and to force the suspension toward the pump impeller. And, (c) withdrawing gas that may collect at the impeller through the tube to be discharged from the pumping system.

It is the primary object of the present invention to provide a system and method for pumping medium consistency paper pulp suspensions, or the like, utilizing an ordinary centrifugal stock pump. This and other objects of the invention will become clear from an inspection of the detailed description of the invention and from the appended claims.

DETAILED DESCRIPTION OF THE DRAWINGS

Figure 1:
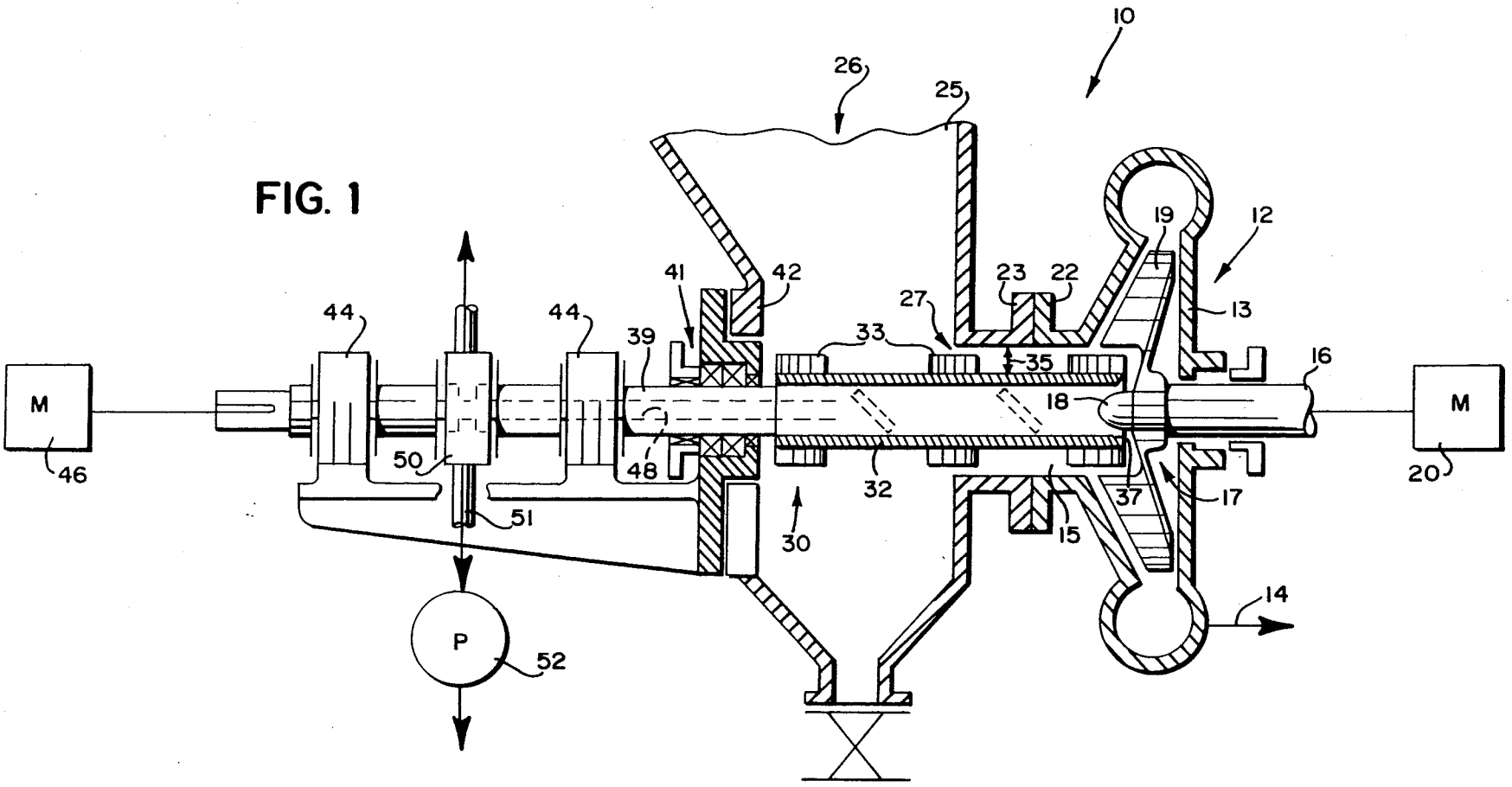
FIG. 1 is a side view, partly in cross-section and partly in elevation, of a pumping system according to the present invention.

A pumping system according to the present invention is shown generally by reference numeral 10 in FIG. 1. While the system can be used with a variety of suspensions, it is eminently suited for use with comminuted cellulosic fibrous suspensions (paper pulp, or stock). It will be described in its preferred embodiment with respect to paper pulp pumping.

One of the major components of the system 10 comprises the centrifugal pump 12. The pump 12 is a standard centrifugal stock pump, which is designed for handling stock of a consistency of about 3–8%. It includes a housing 13 having an outlet 14 and an inlet 15, with a shaft 16 for rotating an impeller 17 about an axis (a generally horizontal axis in the embodiment illustrated in FIG. 1). The impeller 17 includes a hub 18 and a plurality of blades 19, which can take a wide variety of forms and shapes, but preferably are solid and are illustrated only schematically in the drawings. The shaft 16 is rotated about its axis by the rotating means 20, which rotates the impeller 17 in the direction of arrow 21 (see FIG. 2), at a speed that many vary widely, but typically is in the neighborhood of 600 rpm. The speed rotation is not sufficient to normally fluidize pulp having a consistency of about 8% or more.

The housing 13 of the pump 12 is preferably mounted by an annular flange 22 to a like annular flange 23 of a generally vertically disposed vessel 25, which typically would be a storage vessel but also may be a treatment vessel. Pulp flows downwardly in the vessel 25 in the direction of arrow 26, and flows through a throat 27 into the inlet 15 for the pump 12.

Another major component of the pumping system according to the present invention is a rotatable element, e.g. a vaned tubular element 30. The element 30 comprises a hollow tubular body 32 having a plurality of vanes 33 thereon. The vanes may be in the form of ribs (right or helical), and may be continuous or—as illustrated in the drawings—discrete. The tube 32 and the vanes 33 are dimensioned with respect to the throat 27 so that there is only a small clearance between the vanes and the throat 27 and inlet 15. The clearance 35 may be no more than a few centimeters, but the exact clearance will depend upon the particular conditions. The purpose of the small clearance 35, however, is to assist the tube 30—when rotated as described subsequently—to fluidize the pulp as it moves downwardly in vessel 25 toward inlet 15.

The tube 30 has an open end 37. The tube 32 is mounted, by the shaft 39, bearings 41 and flange 42, and bearings 44, for rotation about an axis that is essentially coincident with the impeller axis, and so that the end 37 is adjacent, but slightly (e.g. a few centimeters) spaced from the hub 18 of the pump 12. The spacing between the open end 37 of the tube 32 and the hub 18 is such that little or no suspension will enter the hollow tube 32 during normal operating conditions, but any gas which may collect at the axis of the impeller (as typically occurs when pumping medium consistency suspensions) may pass into the hollow interior of the tube 32.

The system 10 also includes means—such as motor 46—for rotating the tube 30 (via shaft 39) at a speed sufficient to fluidize pulp having a consistency of about 8—15%. The rotation of an element at a fluidizing speed is described in U.S. Pat. No. 4,093,506, the disclosure of which is hereby incorporated by reference herein. Speed of rotation typically is greater than 8OO rpm (typically greater than the speed of rotation of impeller 17), although it may vary widely. Also, it is highly desirable to rotate the element 30, via shaft 39, in the direction of rotation 47 (see FIG. 2), which is opposite to the direction of rotation 21 of the impeller 17. The rotation of the vaned tube 30 causes the pulp to be fluidized, and forces the pulp toward the impeller 17, so that it is immediately acted upon the blades 19 while it is in the fluidized condition.

Means are also preferably provided for the removal of gas, which collects at the impeller axis and has a tendency to move into the tube 32. For this purpose, a passage 48 is provided in the shaft 39. The passage 48 continues to the stationary housing 50, which surrounds the shaft 39, and at the housing 50 one or more radially extending passages are provided communicating with the axial passage 48 in the shaft 39, to allow the gas to move radially outwardly into one or more gas discharge conduits 51. Typically, the normal rotation of the shaft 39 and tube 30 will have a tendency to draw gas from the tube 32 to be discharged through the pipes 51, however where desired some short blade elements which extend radially may be provided on the shaft 39 within the housing 50 to facilitate gas movement, and if desired the tube 51 may be hooked up to an optional exterior vacuum pump 52.

Utilizing the system as illustrated in FIG. 1, a normal stock pump 12 is capable of pumping pulp suspensions having a consistency of about 8–15%, the speeds of rotation of the vaned tube 30 and the impeller 17 being set independently and to the desired levels depending upon the particular conditions encountered (although usually the rotational speed of element 30 is greater than that of element 17).

Utilizing the system 10, it is possible to practice a method of pumping a suspension of cellulosic fibrous material having a consistency of about 8–15%. The method comprises the steps of feeding the cellulosic fibrous material suspension at a consistency of about 8–15% toward the inlet 15 to the pump housing 13; rotating the element 30 at a velocity sufficient to cause the suspension in the area of throat 27 to be fluidized, and to be forced toward the pump impeller 17; and rotating the pump impeller 17, utilizing motor 20, to effect discharge of the suspension from the pulp outlet 14. Also, preferably there is the further step of withdrawing gas from adjacent the impeller, the gas withdrawal step consisting essentially of causing the gas to flow through the hollow tube 32, and gas passageway 48, to be discharged through conduit 51 at a position remote from the impeller 17. In this way there is no reason to tamper with the pump 12 itself, as by providing gas passageways therein or hooking a vacuum pump up to it, the pump 12 remaining devoid of vacuum gas removal means. During the practice of the method, the speeds of rotation of the elements 32, 17 are independently controlled, and preferably they are in opposite directions (21, 47—see FIG. 2).

The invention also contemplates a method of retrofitting a conventional pumping system which is capable of handling stock having a consistency of about 3–8%, so that it is capable of pumping medium consistency stock. Pre-existing components of a conventional stock pump would consist of all of the elements illustrated in FIG. 1 except for the vaned tube 30 and the elements associated therewith. Retrofitting is easily accomplished merely by forming an opening in the vessel 25 opposite the inlet 15, and utilizing flange 42 and packing 41—and with accessory support structures for bearings 44 mounted on the flange 53 and outstanding arm 54, for cooperation with the flange 42, the structure is easily mounted in place. The vaned tube 30 is positioned so that the open end 37 thereof is adjacent but spaced from the hub 18, and the tube 32 and vanes 33 are dimensioned so that the clearance 35 between the vanes 33 and the throat 27 is small enough to facilitate fluidization of the pulp by the rotating vaned tube 30.

Figure 2:
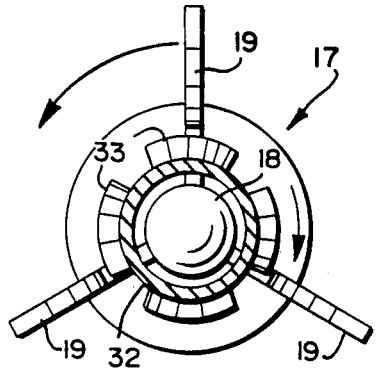
FIG. 2 is a top view, with the tube in cross-section, of merely the tube and the embodiment of impeller of the pumping system of FIG. 1.
Figure 3:
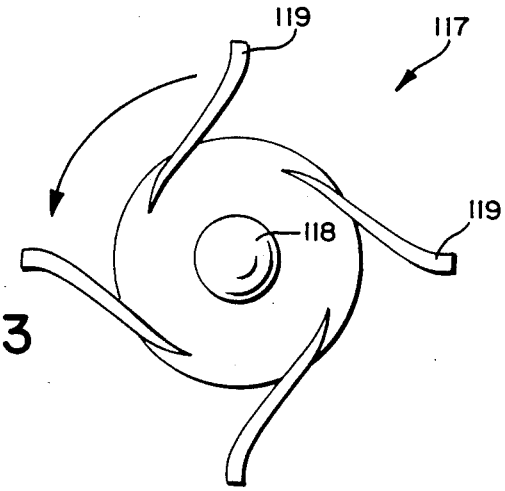
FIGS. 3 and 4 are views like that of FIG. 2, only with the tube removed too, for two different other embodiments of an exemplary impeller of a pumping system according to the invention.
Figure 4:
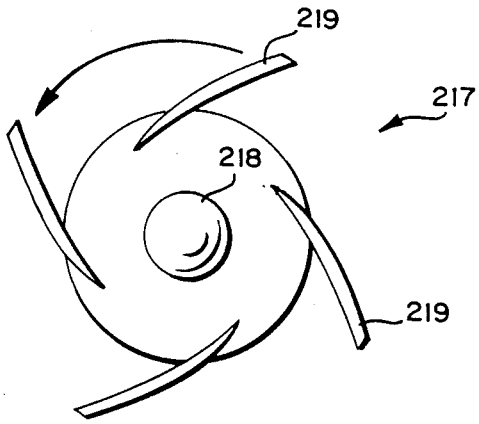

FIGS. 3 and 4 illustrate two alternative embodiments of pumping systems according to the invention, which systems differ from that of FIGS. 1 and 2 essentially only in the configuration of the impellers. While the impeller of the FIG. 2 embodiment is very practical for fluidizing the pulp, it is less efficient for pumping. The FIGS. 3 and 4 embodiment impellers are about twice as efficient, or more, as the FIG. 2 embodiment as far as actual pulp pumping efficiency is concerned. In these embodiments structures comparable to those in the FIG. 2 embodiment are shown by the same two digit reference numeral, only preceded by a "1" in the case of the FIG. 3 embodiment, and preceded by a "2" in the case of the FIG. 4 embodiment.

The impeller 117 has a hub 188 and solid blades 119 which curve slightly convexly at the ends thereof, as illustrated in FIG. 3. The impeller 217 has a hub 218 and solid blades 219 which have a concave outer periphery.

It will thus be seen that according to the present invention a method and apparatus have been provided which allow a conventional centrifugal stock pump to pump medium consistency pulp. While the invention has been illustrated in a preferred form, many modifications thereof may be made within the scope of the invention. For example, while the tube 32 and shaft 39 have been shown as separate elements, under some circumstances they could be the same continuous element, and the passageway 48 and the interior of the tube 32 could have the same diameter; or the diameter could be tapered from the largest point at the open end 37 to the smallest point at the housing 50. A wide variety of other modifications are also possible, thus the invention is to be accorded the broadest interpretation of the appended claims so as to encompass all equivalent systems and methods.

What is claimed is:

1. A pumping system for suspensions comprising:

(a) a centrifugal pump having a housing contained an impeller, the impeller having a solid hub and blades;

(b) means for rotating said impeller about an impeller axis, in a first direction of rotation;

(c) means defining an inlet to said housing, and an outlet from said housing, for suspension being pumped;

(d) an elongated vaned tubular element having an open end, said tubular element at said open end having an inside diameter greater than the diameter of said hub;

(e) means for mounting said tubular element for rotation about an axis generally in line with said impeller axis, and so that the open end extends through said inlet so that it is positioned adjacent, but spaced from, said hub, but overlapping said hub in the dimension of elongation thereof; and (f) means for rotating said tube about its axis in a second direction of rotation, opposite said first direction.

2. A system as recited in claim 1 wherein said means (e) and (f) comprise a shaft having a gas passage therein operatively communicating with the hollow interior of said tube; and further comprising (g) means for withdrawing gas which collects adjacent the impeller from the pump, through said tube and gas passage.

3. A system as recited in claim 2 wherein said means (g) includes a vacuum pump operatively connected to the gas passage in said shaft.

4. A system as recited in claim 1 wherein said means (f) includes a motor for rotating said shaft and tube at a velocity sufficient to fluidize paper pulp having a consistency of about 8–15 %.

5. A system as recited in claim 4 wherein said means defining said inlet comprises a throat, the throat, tube, and vanes on the tube being dimensioned so that there is a narrow clearance between said vanes and said throat so as to facilitate fluidization of the suspension.

6. A system as recited in claim 1 further comprising a generally vertically disposed vessel for containing suspension, said pump being disposed adjacent the bottom of the vessel and all of said elements (a) through (f) mounted so that said impeller axis is generally horizontal.

7. A pumping system for pumping suspensions having a solids content of about 8–15%, comprising:

(a) a centrifugal pump having a housing containing an impeller, the impeller having a hub and blades;

(b) means for rotating said impeller about an impeller axis, in a first direction of rotation;

(c) means defining an inlet to said housing, and an outlet from said housing, for suspension being pumped;

(d) a vaned rotatable element having a free end;

(e) means for mounting said rotatable element for rotation about an axis generally in line with said impeller axis, and so that the free end extends through said inlet so that it is positioned adjacent, but spaced from, said hub;

(f) means for rotating said rotatable element about its axis at a velocity sufficient to fluidize the suspension of consistency about 8–15%;

(g) said means defining said inlet comprising a throat, said throat, rotatable element, and vanes on said element dimensioned so that there is a narrow clearance between said vanes and said throat to facilitate fluidization of the suspension by said element.

8. A system as recited in claim 7 wherein said rotatable element is tubular and said free end is open, and wherein said means (e) and (f) comprising a shaft with a gas passage therein operatively communicating with the hollow interior of said tube; and further comprising:

(h) means for withdrawing gas from said tube and gas passage.

9. A system as recited in claim 7 further comprising a generally vertically disposed vessel for containing suspension, said pump being disposed adjacent the bottom of the vessel and all of said elements (a) through (g) mounted so that said impeller axis is generally horizontal.

10. A pumping system for suspensions comprising:

(a) a centrifugal pump having a housing containing an impeller, the impeller having a hub and blades;
(b) means for rotating said impeller about an impeller axis, in a first direction of rotation;
(c) means defining an inlet to said housing, and an outlet from said housing, for suspension being pumped;
(d) a vaned tubular element having an open end;
(e) means for mounting said tubular element for rotation about an axis generally in line with said impeller axis, and so that the open end extends through said inlet so that it is positioned adjacent, but spaced from, said hub; and
(f) means for rotating said tube about its axis in a second direction of rotation, opposite said first direction;
said means (f) including a motor for rotating said shaft and tube at a velocity sufficient to fluidize paper pulp having a consistency of about 8–15%, and
said means defining said inlet comprising a throat, the throat, tube, and vanes on the tube being dimensioned so that there is a narrow clearance between said vanes and said throat so as to facilitate fluidization of the suspension.

11. A pumping system for suspensions comprising:
(a) a centrifugal pump having a housing containing an impeller, the impeller having a hub and blades;
(b) means for rotating said impeller about an impeller axis, in a first direction of rotation;
(c) means defining an inlet to said housing, and an outlet from said housing, for suspension being pumped;
(d) a vaned tubular element having an open end;
(e) means for mounting said tubular element for rotation about an axis generally in line with said impeller axis, and so that the open end extends through said inlet so that it is positioned adjacent, but spaced from, said hub;
(f) means for rotating said tube about its axis in a second direction of rotation, opposite said first direction;
wherein said means (e) and (f) comprising a shaft having a gas passage therein operatively communicating with the hollow interior of said tube; and
(g) means for withdrawing gas which collects adjacent the impeller from the pump, through said tube and gas passage; and
wherein said means (f) includes a motor for rotating said shaft and tube at a velocity sufficient to fluidize paper pulp having a consistency of about 8–15%.

12. A system as recited in claim 11 wherein said means defining said inlet comprises a throat, the throat, tube, and vanes on the tube being dimensioned so that there is a narrow clearance between said vanes and said throat so as to facilitate fluidization of the suspension.

13. A method of pumping a suspension of cellulosic fibrous material having a consistency of about 8–15% utilizing a centrifugal pump having an impeller with a hub and blades mounted in a housing having an inlet and an outlet, and a vaned element with a free end adjacent but spaced from the hub of the impeller, the impeller and tube being rotatable about a substantially common axis, comprising the steps of:
(a) feeding the cellulosic fibrous material suspension at a consistency of about 8–15% toward the inlet to the pump housing;
(b) rotating the vaned element at a velocity sufficient to cause the suspension to be fluidized and to be forced toward the pump impeller; and
(c) rotating the pump impeller to effect discharge of the suspension from the pump outlet.

14. A method as recited in claim 13 comprising the further step (d) of withdrawing gas from adjacent the impeller.

15. A method as recited in claim 14 wherein the vaned element comprises a tube, and the free end thereof is open, and wherein step (d) consists essentially of the step of causing gas to flow through the tube to be discharged at a position remote from said impeller.

16. A method as recited in claim 15 wherein steps (b) and (c) are practiced to cause the impeller to rotate in the opposite direction of rotation as the tube.

17. A method as recited in claim 13 wherein steps (b) and (c) are practiced to cause the impeller to rotate in the opposite direction of rotation as the vaned element, at a slower speed than the vaned element.

18. A method of retrofitting a centrifugal pumping system capable of handling cellulosic fibrous material suspension having a consistency of about 3–8%, so that it is capable of pumping a suspension having a consistency up to about 15%, the system including a centrifugal pump having a housing with an inlet, an outlet, and an impeller with the hub and blades rotatable about an impeller axis, said method comprising the steps of:
(a) mounting a vaned hollow tube so that it extends through the inlet to the centrifugal pump, with an open end of the tube mounted adjacent, but spaced from, the hub of the impeller, and with the tube vanes having a small clearance between them and the inlet to the housing, and mounting the tube so that it is rotatable about an axis generally coincident with the impeller axis;
(b) rotating the tube in a direction of rotation opposite to the direction of rotation of the impeller, and at a speed sufficient to fluidize pulp suspension having a consistency of up to about 15% and to force the suspension toward the pump impeller; and
(c) withdrawing gas that may collect at the impeller through the tube to be discharged from the pumping system.

* * * * *